US011267685B2

(12) United States Patent
Zielonka et al.

(10) Patent No.: US 11,267,685 B2
(45) Date of Patent: Mar. 8, 2022

(54) BEVERAGE CONTAINMENT AND DISPENSING SYSTEM

(71) Applicant: Growler Power, LLC, Broad Brook, CT (US)

(72) Inventors: Robert Zielonka, Broad Brook, CT (US); Louis Westfall, South Windsor, CT (US); Steve Eustratios Haldezos, West Haven, CT (US)

(73) Assignee: Growler Power, LLC, Broad Brook, CT (US)

( * ) Notice: Subject to any disclaimer, the term of this patent is extended or adjusted under 35 U.S.C. 154(b) by 44 days.

(21) Appl. No.: 16/830,591

(22) Filed: Mar. 26, 2020

(65) Prior Publication Data

US 2020/0317497 A1 Oct. 8, 2020

Related U.S. Application Data

(60) Provisional application No. 62/824,450, filed on Mar. 27, 2019.

(51) Int. Cl.

| | |
|---|---|
| ***B67D 1/00*** | (2006.01) |
| ***B67D 1/12*** | (2006.01) |
| *B67D 1/08* | (2006.01) |

(52) U.S. Cl.

CPC ..... *B67D 1/0075* (2013.01); *B67D 1/0009* (2013.01); *B67D 1/12* (2013.01);

(Continued)

(58) Field of Classification Search

CPC ..... B67D 1/0075; B67D 1/009; B67D 1/12; B67D 2001/0824; B67D 2001/0096; B67D 2001/0092; B67D 1/04; B67D 3/0009

(Continued)

(56) References Cited

U.S. PATENT DOCUMENTS 4,706,847 A * 11/1987 Sankey ..... B67D 1/04 137/329.4
4,932,561 A * 6/1990 Boxall ..... B67D 1/04 137/487.5

(Continued)

OTHER PUBLICATIONS

GrowlTap, https://web.archive.org/web/20190318112529/https://growltap.com/growltap-the-beer-growlers-best-friend/ , Mar. 18, 2019.

(Continued)

*Primary Examiner* — Vishal Pancholi
*Assistant Examiner* — Robert K Nichols, II
(74) *Attorney, Agent, or Firm* — Ryan, Mason & Lewis, LLP

(57) ABSTRACT

Apparatus, and methods for constructing and implementing beverage containment and dispensing systems are provided herein. An example apparatus includes a thermally-insulated container, an adjustable pressure regulator positioned within the thermally-insulated container, a stopper component, and one or more tubes connected to the adjustable pressure regulator and to the stopper component. The example apparatus also includes an external housing within which the thermally-insulated container is contained, and a user-controllable faucet component affixed to the external housing and connected to the adjustable pressure regulator through the external housing and thermally-insulated container via at least one conduit.

18 Claims, 4 Drawing Sheets

(52) U.S. Cl.
CPC ..... *B67D 2001/0092* (2013.01); *B67D 2001/0096* (2013.01); *B67D 2001/0824* (2013.01); *B67D 2210/00047* (2013.01); *B67D 2210/00128* (2013.01)

(58) Field of Classification Search
USPC ..... 222/399, 146.6, 131, 183, 152
See application file for complete search history.

(56) References Cited

U.S. PATENT DOCUMENTS

| | | | | |
|---|---|---|---|---|
| 5,112,539 | A | 5/1992 | Parnet | |
| 5,564,602 | A * | 10/1996 | Cleland | F25D 17/02 222/146.6 |
| 7,861,892 | B1 | 1/2011 | White et al. | |
| 8,348,097 | B2 * | 1/2013 | Nishino | B67D 1/0885 222/91 |
| 8,887,959 | B2 | 11/2014 | Hill et al. | |
| 9,156,670 | B2 | 10/2015 | Hill et al. | |
| 9,193,577 | B2 | 11/2015 | McIntyre et al. | |
| 9,227,827 | B1 | 1/2016 | Scott | |
| D765,469 | S | 9/2016 | Hill et al. | |
| 9,533,865 | B2 | 1/2017 | Sonnichsen et al. | |
| 9,580,286 | B2 | 2/2017 | McIntyre et al. | |
| 9,611,131 | B2 | 4/2017 | Lehman | |
| 9,821,994 | B2 | 11/2017 | McIntyre et al. | |
| 9,919,910 | B2 | 3/2018 | Gibson et al. | |
| 9,950,917 | B2 | 4/2018 | Chapman et al. | |
| 9,994,437 | B2 | 6/2018 | Showalter | |
| 10,065,848 | B2 | 9/2018 | Volin | |
| 10,081,530 | B2 | 9/2018 | Gibson et al. | |
| 10,106,394 | B2 | 10/2018 | Rege et al. | |
| D832,704 | S | 11/2018 | Seiders et al. | |
| D834,373 | S | 11/2018 | Spivey et al. | |
| 10,364,137 | B2 | 7/2019 | Hollister | |
| 2008/0093384 | A1 * | 4/2008 | Fire | B67D 1/0412 222/144.5 |
| 2008/0264953 | A1 | 10/2008 | Lowman | |

OTHER PUBLICATIONS

Growler Werks, uKeg 64, https://web.archive.org/web/20170904025055/https://www.growlerwerks.com/products/ukeg-64-pressurized-growler , Sep. 4, 2017.
Drinking in America, Meet the Brauler, http://www.drinkinginamerica.com/meet-the-brauler/ , Jun. 13, 2011.
Paste Magazine, 7 Ridiculous, But Kind of Awesome, Beer Gadgets, https://www.pastemagazine.com/drink/gadgets/7-ridiculous-but-kind-of-awesome-beer-gadgets/ , Jan. 18, 2016.
The Manual, ManCan is the Indestructable Beer Container You Need, https://www.themanual.com/food-and-drink/mancan-growler/ , May 24, 2018.

* cited by examiner

BEVERAGE CONTAINMENT AND DISPENSING SYSTEM

FIELD

The field relates generally to food and drink technologies, and more particularly to beverage systems.

BACKGROUND

Conventional devices enabling users to pour beverages through a faucet commonly utilize compressed beverage gas. However, such conventional devices are typically not portable and/or sufficiently durable, and have limited compatibility with only specific and often customized vessel designs. Similarly, such conventional devices typically provide a limited or lack of thermal control and/or manipulation capabilities.

SUMMARY

Illustrative embodiments of the invention provide beverage containment and dispensing systems. An example beverage system apparatus includes a thermally-insulated container, an adjustable pressure regulator positioned within the thermally-insulated container, a stopper component, and one or more tubes connected to the adjustable pressure regulator and to the stopper component. The example beverage system apparatus also includes an external housing within which the thermally-insulated container is contained, and a user-controllable faucet component affixed to the external housing and connected to the adjustable pressure regulator through the external housing and thermally-insulated container via at least one conduit.

Additionally, an example method for implementing such a beverage system apparatus includes positioning a beverage vessel within the beverage system apparatus, and positioning a first end of at least one tube within the beverage vessel through an opening of the beverage vessel, wherein a second end of the at least one tube is connected to a pressure regulator contained within the beverage system apparatus. The example method also includes inserting a stopper component into the opening of the beverage vessel, wherein the stopper component comprises at least one hole through which at least a portion of the at least one tube is positioned, enabling adjustment of the pressure regulator in accordance with one or more parameters, and enabling dispensing of the beverage from the beverage vessel via a faucet component on an external portion of the beverage system apparatus.

Illustrative embodiments can provide significant advantages relative to conventional beverage containment and/or dispensing systems. As detailed herein, versatility, preservation, and usability problems associated with conventional beverage systems are overcome through the implementation of a sealed, portable, thermally-controlled beverage system that can maintain a range of consistent pressure for prolonged periods of time.

These and other illustrative embodiments described herein include, without limitation, apparatus, and methods.

DETAILED DESCRIPTION

As detailed herein, one or more embodiments of the disclosure include beverage containment and dispensing systems. At least one embodiment includes a portable beverage containment and dispensing system that is compatible with multiple sized (including various standard sized) beverage vessels that support a variety of beverage types, and utilizes a thermally-insulated container with one or more incorporated compartments for the inclusion, for example, of ice, ice packs, heat packs, etc., to maintain, lower, and/or raise the temperature of the beverage for a given duration of time.

By way of example, at least one embodiment includes a beverage system designed to preserve, thermally control, and dispense a variety of beverages from various-sized containers (such as, for example, a 64-ounce vessel, also referred to as a growler). By way merely of example, a beverage system apparatus as described herein in accordance with one or more embodiments can be implemented with beverages such as water, sports drinks, lemonade, beer, nitro beer, wine, coffee, nitro coffee, pre-mixed cocktails, etc.

Example and/or illustrative embodiments of the invention will be described herein with reference to exemplary apparatus or other devices. It is to be appreciated, however, that embodiments of the invention are not restricted to use with the particular apparatus or device configurations shown.

Figure 1:
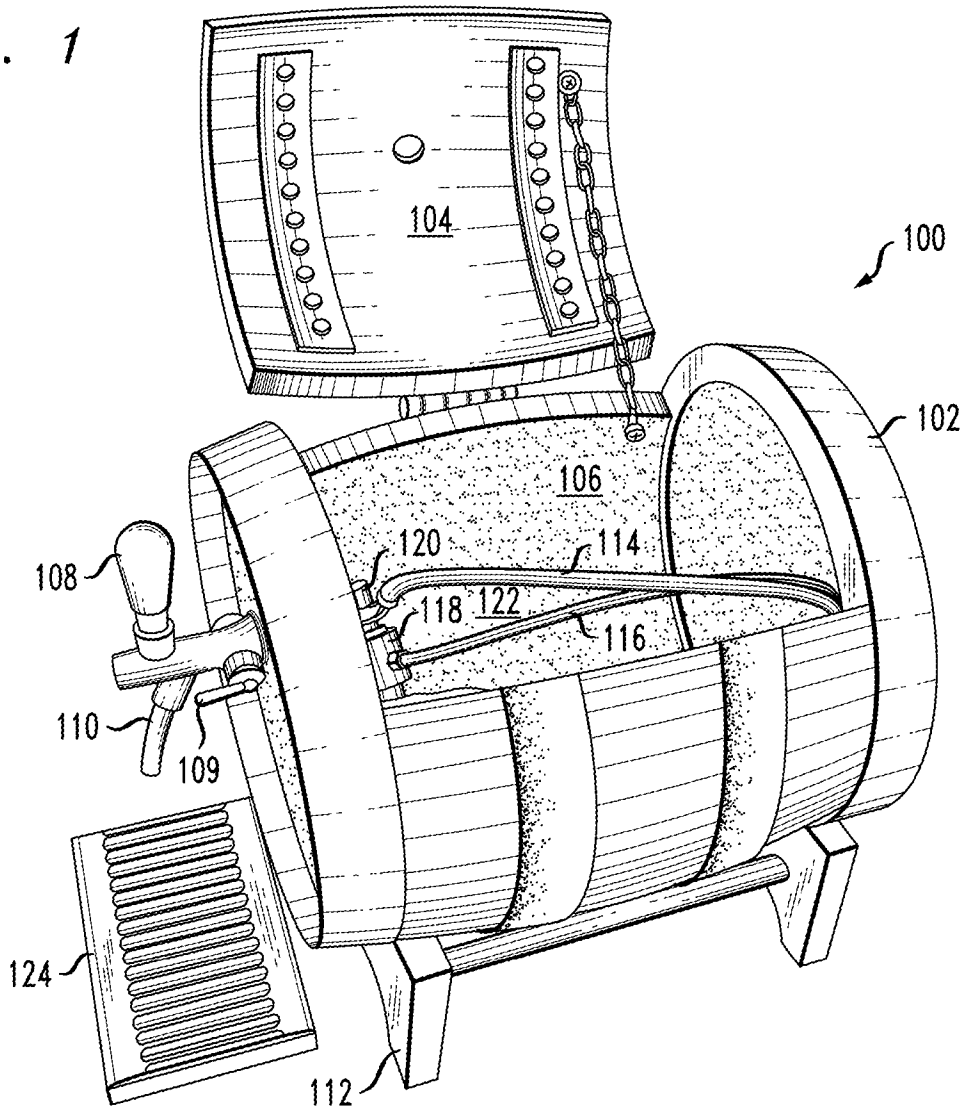
FIG. 1 is a diagram illustrating multiple internal and external components of a beverage system in an example embodiment.
Figure 2:
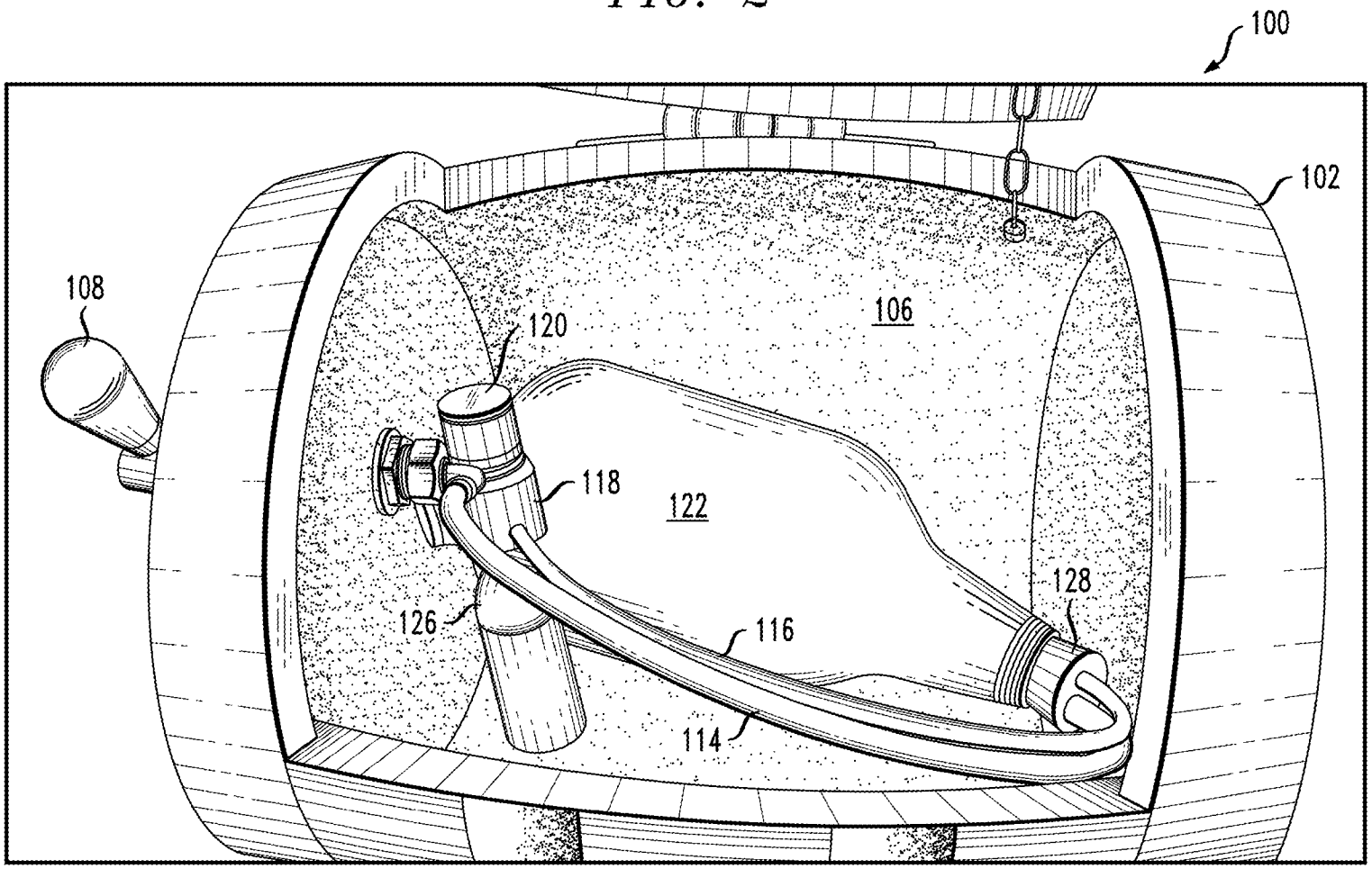
FIG. 2 is a diagram illustrating multiple internal and external components of a beverage system in an example embodiment.

FIG. 1 is a diagram illustrating a first view of multiple internal and external components of a beverage system 100 in an example embodiment. Additionally, FIG. 2 is a diagram illustrating a second view of multiple internal and external components of beverage system 100 in an example embodiment. As commonly illustrated in both FIG. 1 and FIG. 2, beverage system 100 includes an external housing 102, which can take the form of multiple shapes and/or materials. By way merely of example, the external housing 102 can include blow- and/or roto-molded plastic, and can be constructed so as to form an insulated, leak-proof interior. By way of further example, the external housing 102 can also be made from injection molded plastic and/or three-dimensional (3D) printed plastic. In the example embodiment depicted in FIG. 1 and FIG. 2, external housing 102 comprises a barrel shape that is made from one of the above-noted forms of plastic.

Also, in one or more embodiments, beverage system 100 includes a door or gate feature 104 that can include a latch which enables the beverage system 100 to be securely closed and/or locked. In one or more embodiments, a handle (not shown) can also be implemented as part of the door 104 or elsewhere on the external housing 102. Additionally or alternatively, at least one embodiment can include one or more fasteners such that one or more straps can be incorporated to the container design, for example, to support mobility.

By way merely of example, in one or more embodiments, the external housing 102 is large enough to house and/or contain the components illustrated in FIG. 1 (and FIG. 2), while compact enough to fit within a refrigerator and/or be portable. By way merely of example, in such an embodiment, the size range for the external housing 102 can include between approximately 14 and 16 inches wide by between approximately 9 and 12 inches deep by between approximately 1.1 and 12 inches tall/high.

Additionally, as illustrated in FIG. 1 and FIG. 2, beverage system 100 includes the external component of a faucet handle 108, while FIG. 1 also depicts a flow control handle/lever 109 and a faucet 110 connected to the flow control handle/lever 109, all of which in combination enables user-controlled dispensing of a beverage contained within beverage system 100. In accordance with one or more embodiments, a user can control the amount of bubbles or "head" that pours into a glass/cup, and the flow of the dispensed beverage can be controlled through a self-closing feature on the faucet 110. In one or more embodiments, the flow control handle/lever 109 enables the user to moderate the pressure of the beverage/liquid being transferring into the faucet 110, which allows the user to control, for example, the amount and/or level of foam in the dispensed beverage. Such a feature can improve the pouring experience and prevent the user from wasting amounts of the beverage that is being dispensed via the system 100.

Additionally, as an optional feature, FIG. 1 also depicts a retractable and/or portable drip tray 124 that can be used in conjunction with the faucet 110. Further, an additional optional feature depicted in FIG. 1 includes a stand 112 upon which the beverage system 100 can be placed. In one or more embodiments, for example, the stand 112 can be built into the external housing 102. Such a stand 112 can, by way of example, comprise multiple different shapes and multiple different materials.

Internally within beverage system 100, FIG. 1 and FIG. 2 depict a thermally-insulated container 106 to hold a beverage vessel 122. By way of example, in one or more embodiments, the thermally-insulated container 106 can include a saddle (not explicitly shown) upon which the beverage vessel 122 can be placed to limit movement of the beverage vessel 122. Additionally, in at least one embodiment, the thermally-insulated container 106 can also include one or more pockets (not shown) capable of holding and/or containing ice, ice packs, heat packs, etc.

Further, FIG. 1 and FIG. 2 depict a pressure regulator 118 with a gauge 120, and FIG. 2 depicts a compressed beverage gas cylinder 126 (containing, for example, argon (Ar), carbon dioxide ($CO_2$), nitrogen ($N_2$), cellar/beer gas (25-30% $CO_2$, 70-75% $N_2$), etc.) connected to the pressure regulator 118. Also, FIG. 2 depicts a multi-hole (for example, two-hole) stopper 128, which can include holes for food-grade tubing for both gas 116 and beverage/liquid 114. In one or more embodiments, stopper 128 can include a rubber and/or plastic stopper. Via use of the stopper 128, the beverage system apparatus functions as a sealed system that will hold a range of consistent (air) pressure for a prolonged period of time, even with periodic dispensing of the beverage contained therein. Moreover, in connection with one or more embodiments, implementation and/or utilization of the stopper 128 ensures that the beverage vessel 122 remains sealed for a given period of time, and also enables the user to quickly and efficiently change out and/or replace the beverage vessel 122 (such as, for example, when the beverage vessel 122 becomes empty) with a new/different beverage vessel 122'.

Additionally, one or more embodiments include at least one stopper lock component and/or mechanism, which holds the stopper in place under pressure and limits and/or precludes gas leaks. Such a stopper lock component and/or mechanism can be made out of a variety of materials such as, for example, metal wire and/or rope made from fabric, plastic, etc.

Further, at least one embodiment can additionally include a tube weight that connects to the beverage/liquid transfer tube 114. Such a tube weight can be situated at a bottom portion (end portion) of the beverage/liquid tube 114 and ultimately positioned inside the beverage vessel 122 to ensure that approximately all of the liquid is dispensed from the beverage vessel 122.

It is to be understood that the particular set of elements shown in FIG. 1 and FIG. 2 for the beverage system is depicted by way of illustrative example only, and in one or more other embodiments of the invention, additional or alternative elements may be used.

In accordance with one or more example embodiments, implementing a beverage system such as beverage system 100 can be carried out via the following steps (provided merely as an example):

1. Open the thermally-insulated container 106 by unlocking at least one latch and/or lifting the door/top 104. In one or more embodiments, the door/top 104 may be removed completely from the external housing 102, or the door/top 104 may stay connected to the external housing 102 by a hinge. Additionally or alternatively, in one or more embodiments, unlocking at least one latch will result in the door/top 104 opening automatically via use of a spring-loaded mechanism.

2. Ensure that the pressure regulator 118 is in an "off" position.

3. Open a beverage vessel 122 containing a beverage by unlocking at least one stopper lock mechanism and/or removing the cap/top from the top of the beverage vessel 122.

4. Position the beverage/liquid tube 114 into the beverage vessel 122 (through the stopper 128). In one or more embodiments, the gas line/tube 116 and the beverage/liquid line/tube 114 (with tube weight) are attached to the stopper 128 (with the beverage/liquid line/tube 114 drawn through the stopper 128), forming a complete stopper/tube assembly. In such an embodiment, the user positions the beverage/liquid line/tube 114 into the beverage vessel 122 (such that the tube weight touches (approximately) the bottom of the beverage vessel 122). For example, in such an embodiment, the beverage system 100 can include arrows and/or other visual indicators implemented on one or more portions of the beverage system 100 to facilitate guiding the user in positioning the beverage/liquid line/tube 114 into the beverage vessel 122. Additionally or alternatively, one or more embodiments can include utilizing a bent form of tube 114 to facilitate increased extraction of liquid from the beverage vessel 122.

5. Press the stopper 128 into the top of the beverage vessel 122, such that that the beverage vessel 122 is completely sealed (by the stopper 128).

6. Position the beverage vessel 122 on the saddle inside of the thermally-insulated container 106.

7. If the pressure regulator 118 is not secured, secure the pressure regulator 118 to the thermally-insulated container 106 by clamping the pressure regulator 118 to the wall of the container 106, sliding the pressure regulator 118 into a pocket (not pictured) of the container 106, etc.

8. Adjust the pressure regulator 118, via the gauge 120, to the desired pressure (which may depend on the beverage, user preference, etc.).

9. Optionally, place ice or heat packs into one or more pockets of the container 106 as needed to reach and maintain the desired temperature for the beverage.

10. Close the door/top 104 of the thermally-insulated container 106 and optionally lock the container 106 by manipulating a latch on the door/top 104 or elsewhere on the external housing 102.

11. Adjust the flow opening on the beverage faucet 110 as needed and/or desired by manipulating the flow control handle/lever 109.

12. Manipulate the beverage faucet handle 108 to commence disbursing the beverage.

13. Return to step 1 when the beverage has been completed and/or a different beverage is desired for use in connection with the beverage system 100.

14. If compressed beverage gas cylinder 126 runs out of gas, open the thermally-insulated container 106, detach the pressure regulator 118 (from the container 106) and turn the gauge 120 to the "off" position.

15. Replace the empty gas cylinder 126 by manipulating (such as unscrewing, for example) the empty gas cylinder, removing the empty gas cylinder from the pressure regulator 118, and inserting in a new gas cylinder.

16. Return to step 8.

Figure 3A:
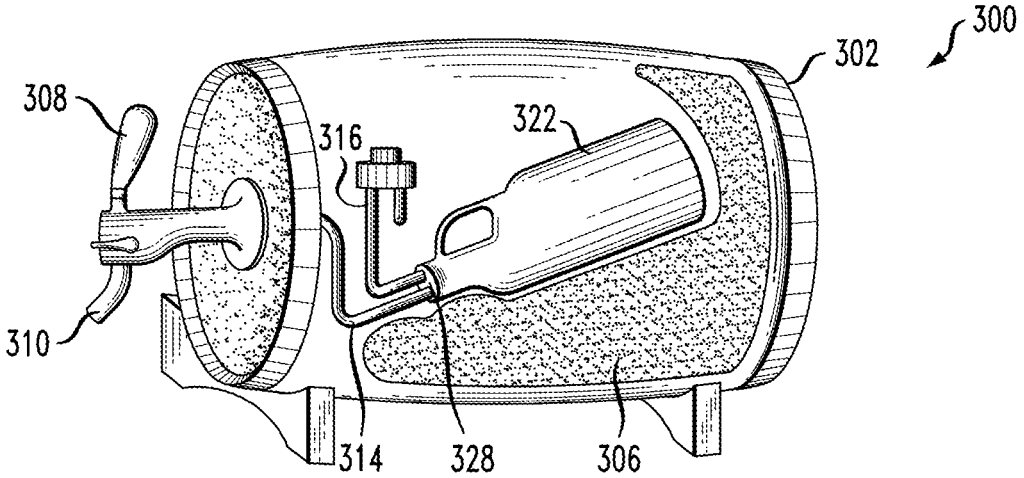
FIG. 3A and FIG. 3B are diagrams illustrating multiple internal and external components of a beverage system in an example embodiment.
Figure 3B:
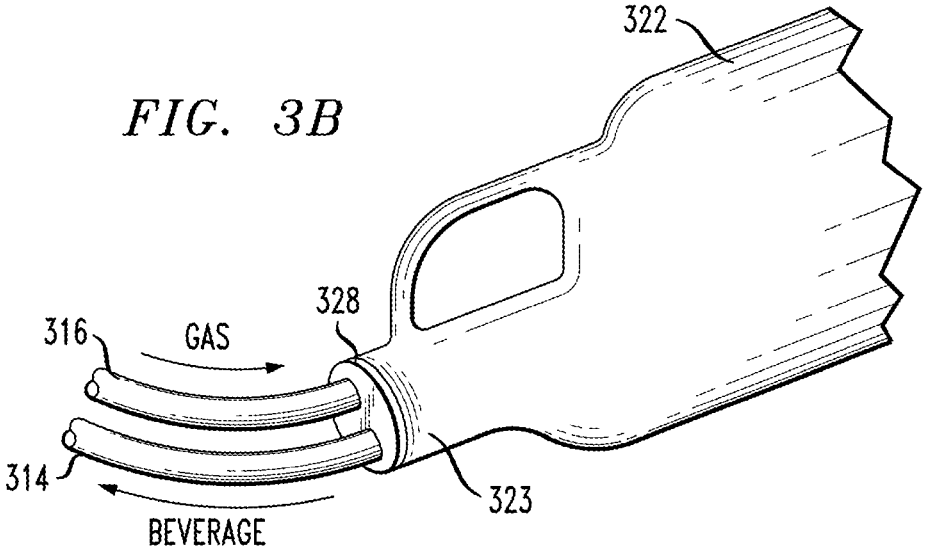

FIG. 3A and FIG. 3B are diagrams illustrating multiple internal and external components of a beverage system in an example embodiment. By way of illustration, FIG. 3A depicts beverage system 300 including external housing 302 with a faucet handle 308 and faucet 310. Within the external housing is a beverage vessel 322 angled downward in a thermally-insulated container 306 such that the fluid/beverage 323 (as depicted in the zoomed-in view illustrated via FIG. 3B) exits the beverage vessel 322 using the force of gravity. In such an embodiment, both a beverage/liquid tube 314 and a gas line/tube 316 are implemented such that the gas and the liquid flow through two holes of the stopper 328 (which is positioned on and/or in one end of the beverage vessel 322). By way of example, such a stopper 328 can include threads that engage directly with threads on one or more standard beverage vessels (e.g., beverage vessel 322) to create and/or ensure a seal. Also, in such an embodiment, the gas line/tube 316 and beverage/liquid tube 314 connect to the stopper 328 using fittings that form in a connection to the stopper 328.

Figure 4:
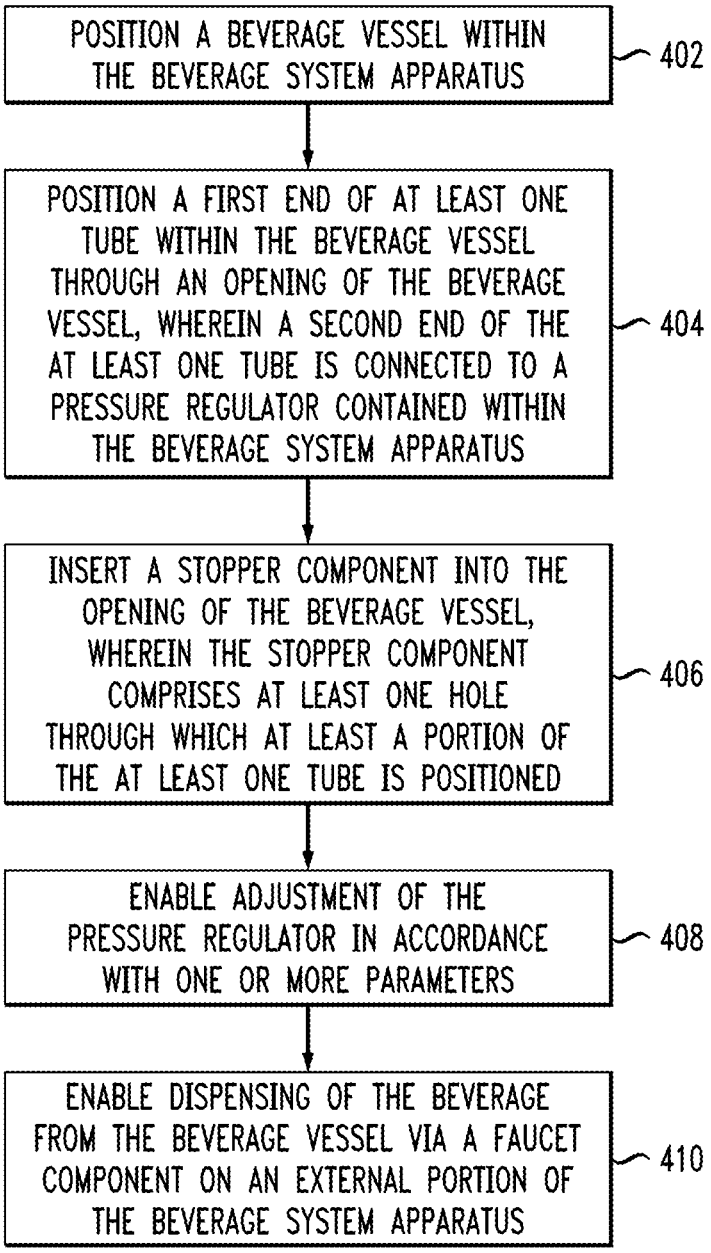
FIG. 4 is a flow diagram of a process for implementing a beverage system apparatus in an example embodiment.

FIG. 4 is a flow diagram of a process for implementing a beverage system apparatus in an example embodiment. In this merely example embodiment, the process includes steps 402 through 410.

Step 402 includes positioning a beverage vessel within the beverage system apparatus. In at least one embodiment, positioning the beverage vessel includes positioning the beverage vessel, within a thermally-insulated container inside of the beverage system apparatus, at a downward angle, wherein an end of the beverage vessel associated with the stopper component is positioned at the downward angle within the thermally-insulated container.

Step 404 includes positioning a first end of at least one tube within the beverage vessel through an opening of the beverage vessel, wherein a second end of the at least one tube is connected to a pressure regulator contained within the beverage system apparatus. Additionally, at least one embodiment includes implementing at least one tube weight at an end portion of the at least one tube, wherein the end portion of the at least one tube is positioned inside the beverage vessel.

Additionally or alternatively, in at least one embodiment, the at least one tube includes a rigid pre-shaped beverage transmission tube, and positioning the first end of such a rigid pre-shaped beverage transmission tube within the beverage vessel includes positioning the first end of the rigid pre-shaped beverage transmission tube inside the beverage vessel at a bottom portion of the beverage vessel.

Step 406 includes inserting a stopper component into the opening of the beverage vessel, wherein the stopper component comprises at least one hole through which at least a portion of the at least one tube is positioned. At least one embodiment also includes implementing at least one stopper lock mechanism proximate to the stopper component, wherein the at least one stopper lock mechanism limits movement of the stopper component under one or more conditions.

Additionally, in one or more embodiments, the at least one tube includes two tubes, the at least one hole of the stopper component includes two holes, and such an embodiment further includes positioning the two tubes through the two holes of the stopper component and into the beverage vessel.

Step 408 includes enabling adjustment of the pressure regulator in accordance with one or more parameters. Step 410 includes enabling dispensing of the beverage from the beverage vessel via a faucet component on an external portion of the beverage system apparatus.

Other techniques can be used in association with one or more embodiments of the disclosure. Accordingly, the particular operations and other functionality described in conjunction with FIG. 4 are presented by way of illustrative example only, and should not be construed as limiting the scope of the invention in any way. For example, the ordering of the process steps may be varied in one or more other embodiments, or certain steps may be performed concurrently with one another rather than serially.

Additionally, as detailed herein, one or more embodiments include a beverage system apparatus that includes a thermally-insulated container, an adjustable pressure regulator positioned within the thermally-insulated container, and a stopper component positioned at one end of a beverage vessel, wherein the beverage vessel is positioned within the thermally-insulated container. Such an apparatus also includes one or more tubes connected to the adjustable pressure regulator and to the stopper component, an external housing within which the thermally-insulated container is contained, and a user-controllable faucet component affixed to the external housing and connected to the adjustable pressure regulator through the external housing and thermally-insulated container via at least one conduit.

In such an embodiment, the stopper component can include a multi-hole stopper component made of rubber and/or plastic. Also, the stopper component can include threads designed to engage threads on one or more beverage vessels. Additionally, one or more embodiments also include at least one stopper lock mechanism positioned proximate to the stopper component, wherein the at least one stopper lock mechanism limits movement of the stopper component under one or more conditions (e.g., when the lock mechanism is engaged with respect to the stopper component). In such an embodiment, the at least one stopper lock mechanism can be made of metal wire, fabric-based rope, and/or plastic-based rope.

Also, in at least one embodiment, the beverage vessel is positioned within the thermally-insulated container at a downward angle, wherein the end of the beverage vessel associated with the stopper component is positioned at the downward angle within the thermally-insulated container.

Further, in one or more embodiments, the apparatus includes at least one tube weight connected to at least a portion of the one or more tubes. In such an embodiment, the at least one tube weight is positioned at an end portion of at least one of the one or more tubes, and wherein the end portion of the at least one tube is positioned inside the beverage vessel. Additionally or alternatively, the one or more tubes connected to the adjustable pressure regulator and to the stopper component can include one pre-shaped beverage transmission tube, wherein the one pre-shaped beverage transmission tube includes a rigid pre-shaped beverage transmission tube configured such that one end of the rigid pre-shaped tube is positioned inside the beverage vessel at a bottom portion of the beverage vessel. Such an embodiment can, for example, cause less beverage to be displaced at the top of the vessel once the tube is inserted (than, for instance, an embodiment that includes using a tube weight) and will allow for more beverage to be initially poured into the vessel.

In order for the rigid pre-shaped (for example, bent) tube to pull beverage from the bottom edge of the beverage vessel (where remaining beverage will commonly collect due to the angle of the vessel and gravity), one or more embodiments can also include implementation of at least one arrow or other marker on the stopper component which will indicate how the stopper component should be positioned relative to vessel's outside handle. In such an embodiment, when the arrow/marker and the vessel's handle are in alignment, the bent tube will be in the proper position inside the vessel. Such an embodiment can be implemented, for example, in connection with a configuration of the system wherein the beverage vessel is angled upwards.

Additionally or alternatively, in at least one embodiment, the one or more tubes include two tubes positioned through two holes of the stopper component and into the beverage vessel.

Also, in one or more embodiments, the external housing is made of blow-molded plastic, roto-molded plastic, injection molded plastic, and/or three-dimensional printed plastic. By way of example, the external housing can be of a size of approximately 14 to 16 inches wide by approximately 9 to 12 inches deep by approximately 11 to 12 inches tall. Further, at least one embodiment additionally includes one or more incorporated thermally-sensitive compartments incorporated into the thermally-insulated container. Also, as detailed herein, in one or more embodiments, the adjustable pressure regulator is connected to at least one compressed beverage gas container, wherein the at least one compressed beverage gas container can include, for example, carbon dioxide.

The herein-described example embodiments provide significant advantages relative to conventional approaches. For example, one or more embodiments can include a sealed, portable, thermally-controlled beverage system that can maintain a range of consistent pressure for prolonged periods of time, even with periodic dispensing of the beverage contained therein.

It is to be appreciated that the foregoing advantages are illustrative of advantages provided in certain embodiments, and need not be present in other embodiments.

It should again be emphasized that the embodiments of the invention described herein are presented for purposes of illustration only. Many variations may be made in the particular arrangements shown. Moreover, the assumptions made herein in the context of describing one or more illustrative embodiments of the disclosure should not be construed as limitations or requirements of the invention, and need not apply in one or more other embodiments of the invention. Numerous other alternative embodiments within the scope of the appended claims will be readily apparent to those skilled in the art.

What is claimed is:

1. A beverage system apparatus comprising:

a thermally-insulated container comprising at least a portion of thermally-insulated material graded at a downward angle, higher at a first side component of the thermally-insulated container and lower at a second side component of the thermally-insulated container, such that the thermally-insulated container is configured to hold a beverage vessel on a downward slope;

an adjustable pressure regulator positioned within the thermally-insulated container;

a stopper component configured to be positioned at one end of a beverage vessel, wherein the one end corresponds to the lower second side component of the thermally-insulated container;

one or more tubes connected to the adjustable pressure regulator and to the stopper component;

an external housing within which the thermally-insulated container is contained; and a user-controllable faucet component affixed to the external housing and connected to the adjustable pressure regulator through the external housing and thermally-insulated container via at least one conduit.

2. The beverage system apparatus of claim 1, wherein the stopper component comprises a multi-hole stopper component.

3. The beverage system apparatus of claim 1, wherein the stopper component comprises at least one of rubber and plastic.

4. The beverage system apparatus of claim 1, further comprising:

at least one stopper lock mechanism positioned proximate to the stopper component, wherein the at least one stopper lock mechanism limits movement of the stopper component under one or more conditions.

5. The beverage system apparatus of claim 4, wherein the at least one stopper lock mechanism comprises one or more of metal wire, fabric-based rope, and plastic-based rope.

6. The beverage system apparatus of claim 1, wherein the stopper component comprises threads designed to engage threads on one or more beverage vessels.

7. The beverage system apparatus of claim 1, wherein the one or more tubes connected to the adjustable pressure regulator and to the stopper component comprises one pre-shaped beverage transmission tube.

8. The beverage system apparatus of claim 7, wherein the one pre-shaped beverage transmission tube comprises a rigid pre-shaped beverage transmission tube.

9. The beverage system apparatus of claim 1, wherein the one or more tubes comprise two tubes positioned through two holes of the stopper component.

10. The beverage system apparatus of claim 1, wherein the external housing comprises one or more of blow-molded plastic, roto-molded plastic, injection molded plastic, and three-dimensional printed plastic.

11. The beverage system apparatus of claim 1, further comprising:

one or more incorporated thermally-sensitive compartments incorporated into the thermally-insulated container.

12. The beverage system apparatus of claim 1, wherein the adjustable pressure regulator is connected to at least one compressed beverage gas container.

13. The beverage system apparatus of claim 12, wherein the at least one compressed beverage gas container is configured to hold at least one of (i) argon (Ar), (ii) carbon dioxide ($CO_2$), (iii) nitrogen ($N_2$), and (iv) a combination of approximately 25-30% $CO_2$ and approximately 70-75% $N_2$.

14. The beverage system apparatus of claim 1, wherein the external housing comprises approximately 14 to 16 inches wide by approximately 9 to 12 inches deep by approximately 11 to 12 inches tall.

15. A method for implementing a beverage system apparatus, comprising:

positioning a beverage vessel within the beverage system apparatus, wherein positioning the beverage vessel comprises positioning the beverage vessel within a thermally-insulated container inside of the beverage system apparatus, wherein the thermally-insulated container comprises at least a portion of thermally-insulated material graded at a downward angle, higher at a first side component of the thermally-insulated container and lower at a second side component of the thermally-insulated container, and wherein positioning the beverage vessel within the thermally-insulated container comprises positioning the beverage vessel on a downward slope within the thermally-insulated container, wherein an end of the beverage vessel associated with a stopper component is positioned at the lower second side component of the thermally-insulated container;

positioning a first end of at least one tube within the beverage vessel through an opening of the beverage vessel, wherein a second end of the at least one tube is connected to a pressure regulator contained within the beverage system apparatus;

inserting the stopper component into the opening of the beverage vessel, wherein the stopper component comprises at least one hole through which at least a portion of the at least one tube is positioned;

enabling adjustment of the pressure regulator in accordance with one or more parameters; and enabling dispensing of the beverage from the beverage vessel via a faucet component on an external portion of the beverage system apparatus.

16. The method of claim 15, further comprising:

implementing at least one stopper lock mechanism proximate to the stopper component, wherein the at least one stopper lock mechanism limits movement of the stopper component under one or more conditions.

17. The method of claim 15, wherein the at least one tube comprises a rigid pre-shaped beverage transmission tube, and wherein positioning the first end of the rigid pre-shaped beverage transmission tube within the beverage vessel comprises positioning the first end of the rigid pre-shaped beverage transmission tube inside the beverage vessel at a bottom portion of the beverage vessel.

18. The method of claim 15, wherein the at least one tube comprises two tubes, wherein the at least one hole of the stopper component comprise two holes, and wherein the method further comprises positioning the two tubes through the two holes of the stopper component and into the beverage vessel.

* * * * *